US012631384B2

(12) United States Patent
Barbely et al.

(10) Patent No.: US 12,631,384 B2
(45) Date of Patent: May 19, 2026

(54) SYSTEMS AND METHODS FOR MANAGING ICE LEVELS IN A BEVERAGE DISPENSER

(71) Applicant: THE COCA-COLA COMPANY, Atlanta, GA (US)

(72) Inventors: Eric Barbely, Atlanta, GA (US); David Mulcahey, Roswell, GA (US)

(73) Assignee: THE COCA-COLA COMPANY, Atlanta, GA (US)

( * ) Notice: Subject to any disclaimer, the term of this patent is extended or adjusted under 35 U.S.C. 154(b) by 162 days.

(21) Appl. No.: 18/691,710

(22) PCT Filed: Sep. 23, 2022

(86) PCT No.: PCT/US2022/044528
§ 371 (c)(1),
(2) Date: Mar. 13, 2024

(87) PCT Pub. No.: WO2023/049338
PCT Pub. Date: Mar. 30, 2023

(65) Prior Publication Data

US 2025/0123044 A1 Apr. 17, 2025

Related U.S. Application Data

(60) Provisional application No. 63/247,852, filed on Sep. 24, 2021.

(51) Int. Cl.
*F25C 5/187* (2018.01)

(52) U.S. Cl.
CPC ..... *F25C 5/187* (2013.01)

(58) Field of Classification Search
CPC .. F25C 2600/04; F25C 2700/02; F25C 5/187; F25C 5/24
See application file for complete search history.

(56) References Cited

U.S. PATENT DOCUMENTS 4,822,996 A 4/1989 Lind
5,460,007 A 10/1995 Reed et al.
(Continued)

FOREIGN PATENT DOCUMENTS

AU 601413 B2 9/1990
EP 3604985 A1 2/2020
WO 2020157565 A1 8/2020

OTHER PUBLICATIONS

Extended European Search Report issued in EP22873626.0, mailed Jun. 13, 2025.

(Continued)

*Primary Examiner* — Henry T Crenshaw
(74) *Attorney, Agent, or Firm* — Meunier Carlin & Curfman LLC

(57) ABSTRACT

A sensor (105) is placed into the ice bin (110) of a beverage dispenser (180). The sensor can measure the current level (102) of ice in the ice bin and can provide the measured level to a control component (115) of the beverage dispenser. The control component of the beverage dispenser can record the measured level and may selectively activate or deactivate an associated ice maker based on the measured levels (300). When the current level is below a minimum threshold (315), the control component may send a signal to the ice maker that causes it to make ice (320). When the current level is above a maximum threshold (330), the control component may send a signal to the ice maker that causes it to stop making ice (335).

18 Claims, 7 Drawing Sheets

(56) References Cited

U.S. PATENT DOCUMENTS

| | | | | |
|---|---|---|---|---|
| 5,553,744 | A | 9/1996 | Sawyer | |
| 6,418,736 | B1 | 7/2002 | Cover | |
| 8,863,985 | B2 | 10/2014 | Berge et al. | |
| 2006/0042298 | A1 | 3/2006 | Elsom et al. | |
| 2006/0150645 | A1* | 7/2006 | Leaver | F25C 5/187 62/340 |
| 2007/0267086 | A1* | 11/2007 | Dunn | F25C 5/00 141/2 |
| 2010/0326093 | A1 | 12/2010 | Watson et al. | |
| 2011/0023505 | A1 | 2/2011 | Popov et al. | |
| 2013/0269377 | A1 | 10/2013 | Bertone | |
| 2016/0116198 | A1 | 4/2016 | Becker et al. | |
| 2016/0305699 | A1 | 10/2016 | Boarman et al. | |
| 2017/0167783 | A1 | 6/2017 | Jeong et al. | |
| 2020/0041190 | A1 | 2/2020 | Sakakibara | |
| 2020/0249066 | A1 | 8/2020 | Gurumohan et al. | |

OTHER PUBLICATIONS

International Search Report and Written Opinion issued in PCT/US2022/044528, mailed Mar. 30, 2023.

* cited by examiner

400

500

600

700

SYSTEMS AND METHODS FOR MANAGING ICE LEVELS IN A BEVERAGE DISPENSER

CROSS-REFERENCE TO RELATED APPLICATIONS

This application claims priority to U.S. Provisional Patent Application Ser. No. 63/247,852, titled "SYSTEMS AND METHODS FOR MANAGING ICE LEVELS IN A BEVERAGE DISPENSER", and filed on Sep. 24, 2021.

BACKGROUND

Beverage dispensers typically have an ice bin that receives and stores ice. When a request for ice is received from a customer by the beverage dispenser, the dispenser provides ice to the customer from the ice bin.

Generally, bins can be filled in two ways, manually and directly from an ice maker. Filling the bin manually requires that an employee or operator periodically take ice from a remote ice maker and manually fill the ice bin using the ice. When filing the ice bin directly from the ice maker, the ice bin is able to receive ice from the ice maker and does not have to be manually filled with ice. For example, an ice maker may be placed above the ice bin, and the ice created by the ice maker may fall directly into the ice bin as it is created by the ice maker.

There are drawbacks associated with both methods for filling ice bins. With respect to manually filling ice bins, employees and operators must periodically look (either in person or using a camera) into the bin to determine when it should be filled. This may lead to wasted employee time when the ice bin does not have to be filled, and customer dissatisfaction if the ice bin runs out of ice at an inopportune time between checks.

With respect to ice bins directly filled by an ice maker, often the ice maker makes more ice than the ice bin can hold or handle. This can result in ice clogging and binding of an auger in the bin, which may result in dispenser damage, possible ice overflow or spillage, and a failure of ice to be received by a customer.

SUMMARY

A sensor is placed into the ice bin of a beverage dispenser. The sensor can measure the current level of ice in the ice bin and can provide the measured level to a control component of the beverage dispenser. The control component of the beverage dispenser can record the measured level and can take one or more actions based on the measured level. These actions may include, but are not limited to, determining that the current level of ice is below one or more ice-level thresholds, and predicting when the ice bin is likely to be depleted. The control component may selectively activate or deactivate an associated ice maker based on the measured levels. When the current level is below a minimum threshold, the control component may send a signal to the ice maker that causes it to make ice. When the current level is above a maximum threshold, the control component may send a signal to the ice maker that causes it to stop making ice.

The control component may further alert an employee or operator when the current ice level falls below a threshold or may send a message to the employee or operator that includes the predicted ice depletion time. The employee or operator may use the information to schedule the refilling of the ice bin.

Other features of the ice bin sensor include the collection of historical ice usage data based on the measured ice levels. This historical data can be used to predict future ice usage, which can be used by an employee or operator to determine the best time to service or disable the ice maker, or to determine whether the ice-level thresholds should be increased or decreases due to predicted demand.

In an embodiment, a beverage dispenser is provided. The beverage dispenser includes a computing device, a sensor, and an ice bin. The computing device is adapted to: receive a current ice level measurement from the sensor; determine that the current ice level measurement satisfies one or more threshold ice levels; and while the current ice level measurement satisfies the one or more thresholds, activate an ice maker, wherein the ice maker is independent from the beverage dispenser.

Embodiments may include some or all of the following features. The sensor may be an ultrasonic sensor or an optical sensor. The computing device may be further adapted to: record the current ice level measurement and a current date and time as ice usage statistics. The computing device may be further adapted to predict future ice demand based on the ice usage statistics. The computing device may be further adapted to recommend a time to service the ice maker based on the predicted future ice demand. The computing device may be further adapted to selectively activate or deactivate the ice maker based on the predicted future ice demand. The one or more thresholds may include a minimum ice threshold, and the computing device may be further adapted to determine that the current ice level measurement satisfies the one or more threshold ice levels when the current ice level measurement is below the minimum ice threshold. The one or more thresholds may include a maximum ice threshold, and the computing device may be further adapted to determine that the current ice level measurement satisfies the one or more threshold ice levels when the current ice level measurement is below the maximum ice threshold. The computing device may be further adapted to report the current ice level measurement to an operator.

In an embodiment, a method for operating an ice maker is provided. The method may include: receiving a current ice level measurement from a sensor in an ice bin by a computing device; determining that the current ice level measurement satisfies one or more threshold ice levels by the computing device; and while the current ice level measurement satisfies the one or more thresholds, activating an ice maker.

Embodiments may include some or all of the following features. The sensor may be an ultrasonic sensor or an optical sensor. The method may further include recording the current ice level measurement and a current date and time as ice usage statistics. The method may further include predicting future ice demand based on the ice usage statistics. The method may further include recommending a time to service the ice maker based on the predicted future ice demand. The method may further include selectively activating or deactivating the ice maker based on the predicted future ice demand. The one or more thresholds comprise a minimum ice threshold, and the method may further include determining that the current ice level measurement satisfies the one or more threshold ice levels when the current ice level measurement is below the minimum ice threshold. The one or more thresholds may include a maximum ice threshold, and the method may further include determining that the current ice level measurement satisfies the one or more threshold ice levels when the current ice level measurement is below the maximum ice threshold. The method may further include reporting the current ice level measurement to an operator.

In an embodiment, a beverage dispenser is provided. The beverage dispenser includes: a computing device; a sensor; and an ice bin. The computing device is adapted to: receive ice usage statistics for the ice bin, wherein the ice usage statistics comprise ice level measurements taken by the sensor at a plurality of dates and times; receive a current ice level measurement from the sensor; based on the ice usage statistics and the current ice level measurement, determine to activate an ice maker; and based on the determination, activate the ice maker, wherein the ice maker is independent from the beverage dispenser. The sensor may be an ultrasonic sensor or an optical sensor.

In an embodiment a beverage dispenser is provided. The beverage dispenser includes: a computing device; a sensor; and an ice bin. The computing device is adapted to: receive a current ice level measurement from the sensor; based on the determined ice level measurement, determine that the ice bin needs more ice; in response to the determination: generate a message about the current ice level; and provide the generated message about the current ice level.

Embodiments may include some or all of the following features. The computing device may be further adapted to: based on the current ice level measurement and one or more previous ice level measurements, determine an ice usage rate for the beverage dispenser; based on the determined ice usage rate, determine a time when the ice bin will need more ice; generate a message that includes the determined time; and provide the generated message that include the determined time. The computing device may be further adapted to: receive a request for the current ice level measurement; in response to the request, determine the current ice level measurement from the sensor; and provide the current ice level measurement. The computing device may be further adapted to: record the current ice level measurement and a current date and time as ice level statistics. The sensor may be an ultrasonic sensor or an optical sensor. Determining that the ice bin needs more ice may include determining that the current ice level measurement is below a minimum ice threshold. The computing device may be further adapted to: record the current ice level measurement and a current date and time as ice usage statistics. The computing device may be further adapted to predict future ice demand based on the ice usage statistics. The computing device may be further adapted to recommend a time to service an ice maker based on the predicted future ice demand.

Additional advantages of the invention will be set forth in part in the description which follows, and in part will be obvious from the description, or may be learned by practice of the invention. The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE DRAWINGS

The accompanying figures, which are incorporated herein and form part of the specification, illustrate a document attachment system and method. Together with the description, the figures further serve to explain the principles of the document attachment system and method described herein and thereby enable a person skilled in the pertinent art to make and use the document attachment system and method.

DETAILED DESCRIPTION

Figure 1:
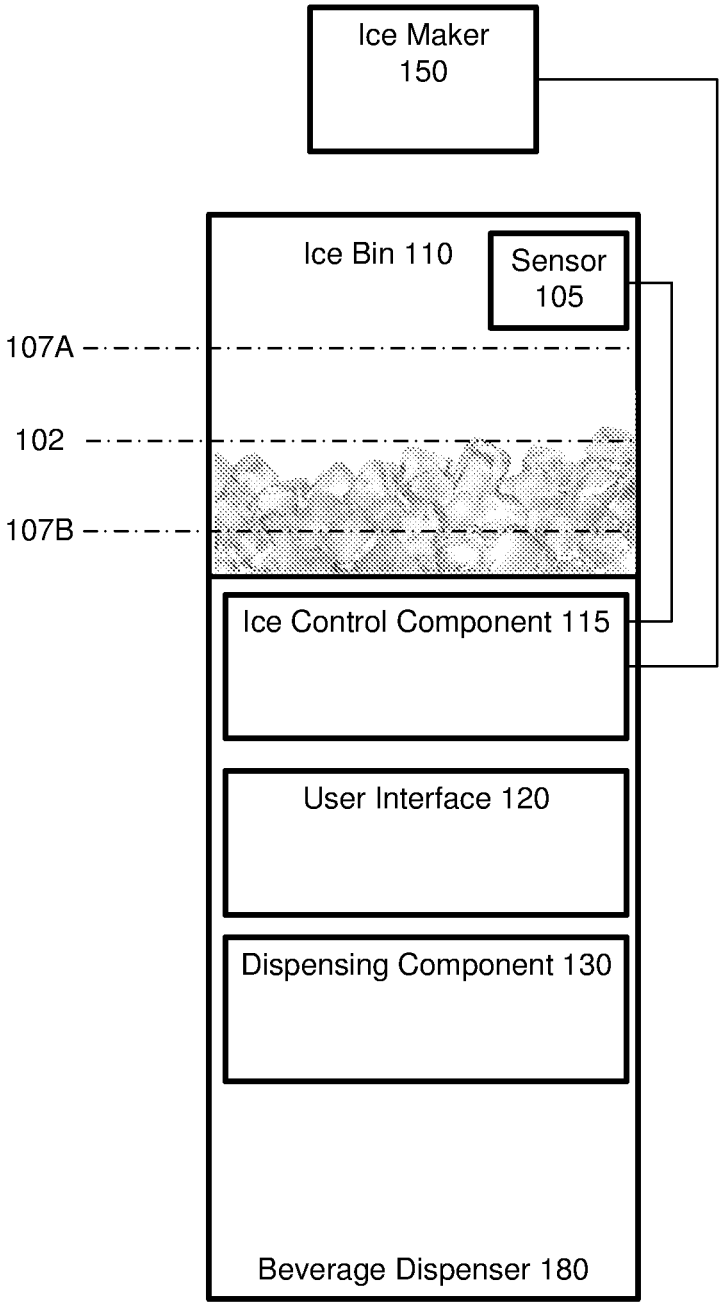
FIG. 1 is an example beverage dispenser.

FIG. 1 is an example beverage dispenser 180 that is configured to dispense one or more beverages (e.g., soda, juice, water, and tea) and ice to customers. As shown, the beverage dispenser 180 includes one or more components such as a user interface 120, a dispensing component 130, an ice control component 115, an ice bin 110, and a sensor 105. More or fewer components may be supported.

In general, a customer may place a vessel (e.g., cup) into the dispensing component 130. The customer may use the user interface 120 to select a beverage, or a combination of beverages, and to select a desired amount of ice. The user interface 120 may then cause the selected beverage and ice to be dispensed by the dispensing component 130 into the vessel. The user interface 120 may further facilitate payment for the beverage by the customer. Depending on the embodiment, the user interface 120 may be a combination of a touch screen interface and/or a physical interface (e.g., buttons). In addition, the customer may interact with the beverage dispenser 180 using a personal computing device (e.g., a smartphone or a table computer).

When a customer selects ice for their beverage, ice is moved out of the ice bin 110 and into the vessel by the dispensing component 130. Depending on the embodiment, the ice bin 110 may include an auger that is adapted to turn and cause ice to move from the ice bin 110 to the vessel via the dispensing component 130.

In one embodiment, there may be an ice maker 150 that is placed above or near the ice bin 110 such that the ice from the ice maker 150 falls into the ice bin 110. In another embodiment, the ice maker 150 may be placed at any location and an employee may periodically fill the ice bin 110 from the ice maker 150. Note that in either embodiment, the ice maker 150 is not part of, and is independent from, the beverage dispenser 180.

As described above, there are many drawbacks associated with current ice bins 110. Ice bins 110 filled directly from an ice maker 150 can become over filled due to a lack of control over the operation of the corresponding ice maker 150. Manually filled ice bins 110 can quickly run out of ice during popular time periods (e.g., lunch and dinner rush) and must be actively monitored by employees.

Accordingly, to solve those and other problems associated with ice bins 110 in beverage dispensers 180, the beverage dispenser 180 includes an ice control component 115 and a sensor 105. The sensor 105 is placed inside of the ice bin 110 and periodically takes measurements of an ice level 102 of the ice bin 110 and provides the measurements to the ice control component 115. For example, the sensor 105 may take a measurement each time the dispensing component 130 dispenses ice. The sensor 105 may be an ultrasonic sensor, contact probe, or an optical sensor (e.g., an image or video sensor), or some combination. Other types of sensors may be used.

The ice control component 115 may receive the ice level 102 and may compare the ice level 102 to one or more ice thresholds 107. If the ice level 102 is below the ice threshold 107, then ice control component 115 may take one or more actions. The actions may include sounding an alarm, turning on a light, or sending an electronic message (e.g., e-mail or SMS message) to an employee or a manager. The actions may further include activating or turning on the ice maker 150. For example, the ice control component 115 may be electronically connected (e.g., wired or wireless) to the ice maker 150 and the ice control component 115 may send a signal to the ice maker 150 that causes the ice maker 150 to start producing ice. At a later time when the measured ice level 102 changes and is no longer below the one or more thresholds 107, the ice control component 115 may send a signal to the ice maker 150 to stop producing ice. The details of the ice control component 115 are described in further detail with respect to FIG. 2.

Figure 2:
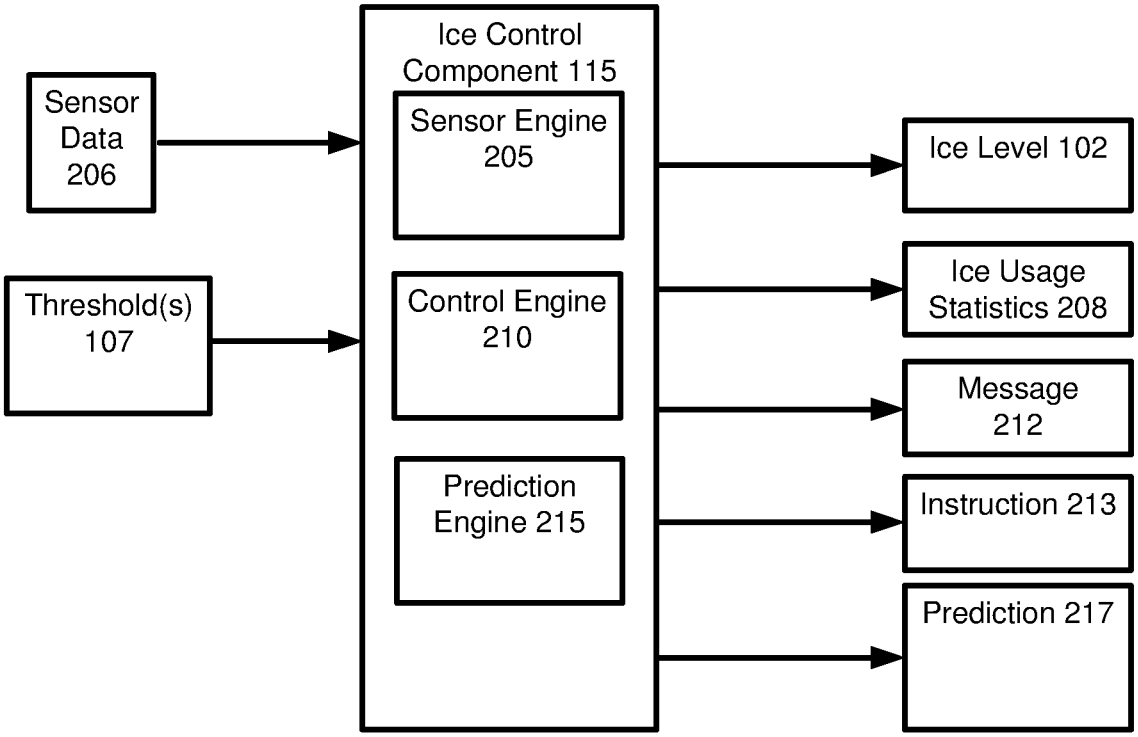
FIG. 2 is an illustration of an example ice control component.

FIG. 2 is an illustration of an example ice control component 115. As shown, the ice control component 115 includes one or more engines including the sensor engine 205, the control engine 210, and the prediction engine 215. More or fewer engines may be supported. Depending on the embodiment, each engine of the ice control control component 115 may be implemented together or separately using one or more general purpose computing devices such as the computing device 700 illustrated with respect to FIG. 7.

The sensor engine 205 may receive sensor data 206 from the sensor 105 and may use the sensor data 206 to determine the current ice level 102 of the ice bin 110. Where the sensor 105 is an ultrasonic sensor, the sensor data 206 may be a measured distance between the top of the ice in the ice bin 110 and the sensor 105. The sensor engine 205 may then determine the ice level 102 based on the measured distance and knowledge about the size/dimensions of the ice bin 110 and the placement of the sensor 105 in the ice bin 110. Alternatively or additionally, the sensor engine 205 may calculate a fill percentage for the ice bin 110.

Where the sensor 105 is an optical sensor, the sensor data 205 may be an image or video of the ice in the ice bin 110. Depending on the embodiment, the sensor engine 205 may use image processing and/or computer vision techniques to determine the current ice level 102. For example, ice cubes may appear smaller in the sensor data 206 as the current ice level 102 drops, and the sensor engine 205 may estimate the ice level 102 based on the relative sizes of the ice cubes. As another example, the ice bin 110 may include various markings on the walls that are either visible or covered by ice depending on the ice level 102. The sensor engine 205 may then determine the current ice level 102 based on the particular markings that are visible in the sensor data 206. Other methods may be used to determine the ice level 102.

The sensor engine 205 may further determine a type of ice in the ice bin 110. In particular, the sensor engine 205 may be able to distinguish between hard or soft ice. Where the sensor 105 is an optical sensor 105, the sensor engine 205 may use image processing and/or computer vision techniques to recognize the type of ice that is visible in the sensor data 206.

In some embodiments, where the sensor is an optical sensor 105, the sensor engine 205 may detect other conditions within the ice bin. For example, the sensor engine 205 may use image processing and/or computer vision techniques and the images from the optical sensor to detect conditions such as ice bridging, a damaged auger, or a cotter pin that has fallen out. When any such conditions are detected the control engine 210 may send a message 212 to an employee, manager, or service technician alerting them to the detected condition. The message 212 may include the images or images in which the condition was detected.

In some embodiments, the sensor engine 205 may use data from the auger of the ice bin 110 in combination with the sensor data 206. For example, where the sensor 105 is an ultrasonic sensor 105, the sensor engine 205 may calculate a rate of change of the ice level 102. The sensor engine 205 may use the rate of change in combination with data about the operation of the auger, such as the auger motor current, to determine how fast the auger is turning. The sensor engine 205 may then estimate the type of ice in the ice bin 110 based on the speed of the auger and the observed rate of change in the ice level 102. Other methods may be used to determine the type of ice in the ice bin 110.

The control engine 210 may perform one or more actions based on the ice level 207. In some embodiments, the control engine 210 may generate and send an instruction 213 to the ice maker 150 to make ice whenever the ice level 102 is below a threshold 107. Once the ice level is observed to be above the threshold 107, the control engine 210 may generate and send an instruction 213 to the ice maker 150 to stop making ice. Where the bin 110 is manually filled, the control engine 210 may send a message 212 to an employee or manager that the ice bin 110 should be filled. The message 212 may indicate the current ice level 102 so the employee can determine how much ice to add to the bin 110. Depending on the embodiment, the control engine 210 may take further actions upon determining that the ice bin level 102 is below a threshold 107, such as sounding an alarm, or activating a light or other visual indicator on the beverage dispenser 180.

In some embodiments, there may be two ice thresholds 107: a maximum ice threshold 107A; and a minimum ice threshold 107B. When the determined ice level 102 is below the minimum ice threshold 107B, the control engine 210 may send an instruction 213 to the ice maker 150 to begin making ice. Once the ice level 102 is above the maximum ice threshold 107A, the control engine 210 may send an instruction 213 to the ice maker 150 to stop making ice.

The control engine 210 may adjust the thresholds 107 based on a variety of information. In some embodiments, the control engine 210 may adjust the thresholds 107 based on whether soft or hard ice is detected. In general, the thresholds 107 may be set lower for soft ice than for hard ice. For example, the maximum threshold 107A may be set between 4 to 7.5 inches higher for hard ice than for soft ice.

In another embodiment, the control engine 210 may increase or decrease the thresholds 107 in response to a measured or predicted demand. For example, the control engine 210 may raise both the minimum threshold 107B and the maximum threshold 107A in response to detecting a high rate of ice usage, or in anticipation of an increase in demand for ice (e.g., before the lunch or the dinner service begins). The control engine 210 may lower the thresholds 107 after the rate of ice usage returns to normal or when demand for ice is predicted to be lower (e.g., after the lunch or the dinner service has ended).

The control engine 210 may record various ice usage statistics 208 based on the sensor data 206. In some embodiments, the ice usage statistics 208 may include the ice levels 102 determined by the control engine 210 and the dates and times that each ice level 102 was determined. The ice usage statistics 208 may further include the rate that the ice level 102 changed for each date and time, the relative hardness or softness of the ice, and the total amount ice dispensed at each date and time. Other information such as images or videos of the ice may be included in the ice usage statistics 208.

The control engine 210 may allow employees or managers to view the current ice level 102 of the ice bin 110, as well as various ice usage statistics 208. In some embodiments, the control engine 210 may expose an interface through which the employees or managers may connect to the control engine 210 and may view the current ice level 102 and may even view current images or videos of the ice in the ice bin 110. The control engine 210 may display any malfunctions or instances when the ice control component 115 was unable to dispense ice because the bin 110 was empty or the auger was jammed, or indications of other detected conditions or problems.

Depending on the embodiment, the control engine 210 may further allow technicians or repair persons to use the interface to access the current ice level 102 and/or ice usage statistics 208. The technicians can use the ice usage statistics 208 and recent ice levels 102 to determine if the ice maker 150 is functioning correctly or should be serviced or repaired.

The prediction engine 215 may use the ice usage statistics 208 to generate one or more predictions 217 related to the ice usage of the beverage dispenser 180. A prediction 217, as used herein may be a predicted ice usage rate or ice demand for particular date or time in the future. The prediction engine 215 may be a model that considers the ice usage statistics 208 at or around a particular date or time in the past to generate a prediction 217 for that particular date or time in the future.

The control engine 210 may consider predictions 217 generated by the prediction engine 215 when generating instructions 213 and/or messages 212 with respect to the ice bin 110. As one example, the control engine 210 may increase or decrease the thresholds 107 based on the prediction 217 for a date and time. If the prediction 217 for a date and time shows a higher-than-average ice usage, then the control engine 210 may increase the thresholds 107 so that the ice bin 110 will hold more ice than usual. In contrast, if the prediction 217 for a date and time shows a lower-than-average ice usage, then the control engine 210 may decrease the thresholds 107 so that the ice bin 110 will hold less ice than usual.

As another example, based on the ice usage statistics 208 the prediction engine 215 may learn that the retail establishment associated with the beverage dispenser 180 is closed on Mondays. Accordingly, for a date and time that falls on a Monday, the prediction engine 215 may generate a prediction 217 that no ice will be used on the date. Accordingly, the control engine 210 may reduce the thresholds 107 (to zero, for example), or may disable the ice maker 150 entirely for the day.

As another example, the control engine 210 may use the predictions 217 for selecting optimal dates and time to schedule cleaning, servicing, cycling, or other maintenance operations for the ice maker 150. The control engine 210 may determine that the ice maker 150 is due for a cleaning and may select an upcoming date and time with the least predicted ice usage. The control engine 210 may generate and send a message 212 to the owner or operator of the ice maker 150 with a recommendation to schedule the cleaning at the selected date and time. In the case of repair or service by technicians, in some embodiments, the control engine 210 may automatically schedule service for the ice maker 150 with the technician at the date and time predicted to have the least ice usage.

Figure 3:
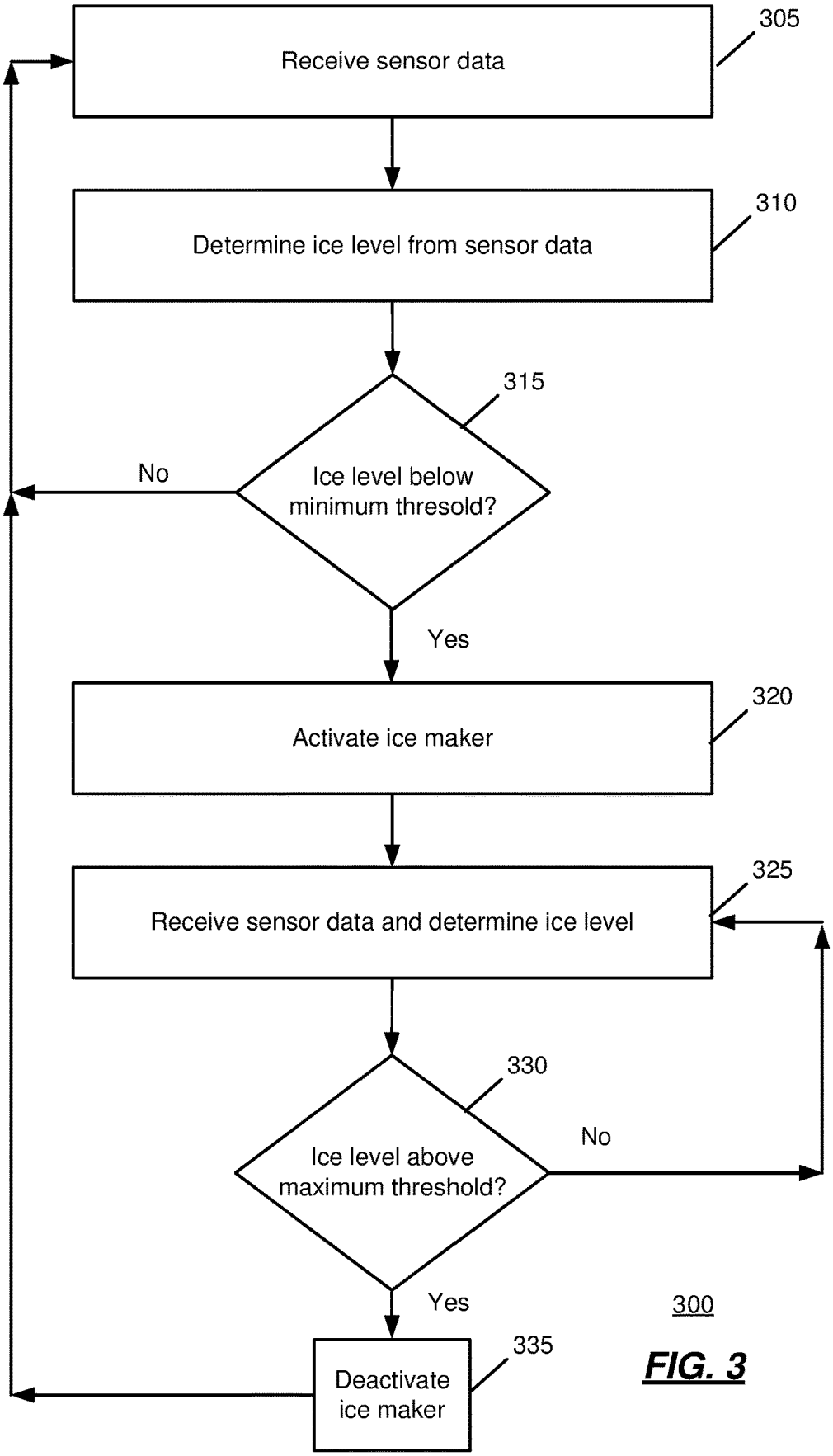
FIG. 3 is an illustration of a method for controlling an ice maker by a beverage dispenser.

FIG. 3 is an illustration of a method 300 for controlling an ice maker by a beverage dispenser. The method 300 may be implemented by the beverage dispenser 180.

At 305, sensor data is received. The sensor data 206 may be received from the sensor 105 in the ice bin 110 by the sensor engine 205 of the ice control component 115. The sensor 105 may be an ultrasonic sensor or an optical sensor.

At 310, an ice level is determined. The ice level 102 may be determined by the sensor engine 205. The ice level 102 may represent the height of the ice in the ice bin 110.

At 315, whether the ice level is below a minimum ice threshold is determined. Whether the ice level 102 is below the minimum ice level threshold 107B may be determined by the control engine 210 of the ice control component 115. If the ice level 102 is below the threshold 107B (indicating that more ice is needed), the method 300 may continue at 320. Else the method 300 may return to 305.

At 320, the ice maker is activated. The ice maker 150 may be activated by the control engine 210 of the ice control component 115. In some embodiments, the control engine 210 may activate the ice maker 150 by sending an instruction 213 to the ice maker 150. The ice maker 150 may then begin making ice in response to the instruction 213. The ice maker 150 may be independent and separate from the beverage dispenser 180 but may receive instructions 213 from the beverage dispenser 180 using a wired or wireless connection.

At 325, the sensor data is received and the ice level is determined. The sensor data and ice level may be determined as described above with respect to 305 and 310. The ice level 102 may be determined as the ice bin 110 is receiving ice from the ice maker 150.

At 330, whether the ice level is above a maximum threshold is determined. Whether the ice level 102 is above the maximum ice level threshold 107A may be determined by the control engine 210 of the ice control component 115. If the ice level 102 is above the threshold 107A (indicating that enough ice has been received), the method may continue at 335. Else the method 300 may return to 325 to continue to monitor the ice level in the ice bin 110 as the ice is received from the ice maker 150.

At 335, the ice maker is deactivated. The ice maker 150 may be deactivated by the control engine 210 of the ice control component 115. In some embodiments, the control engine 210 may deactivate the ice maker 150 by sending an instruction 213 to the ice maker 150.

Figure 4:
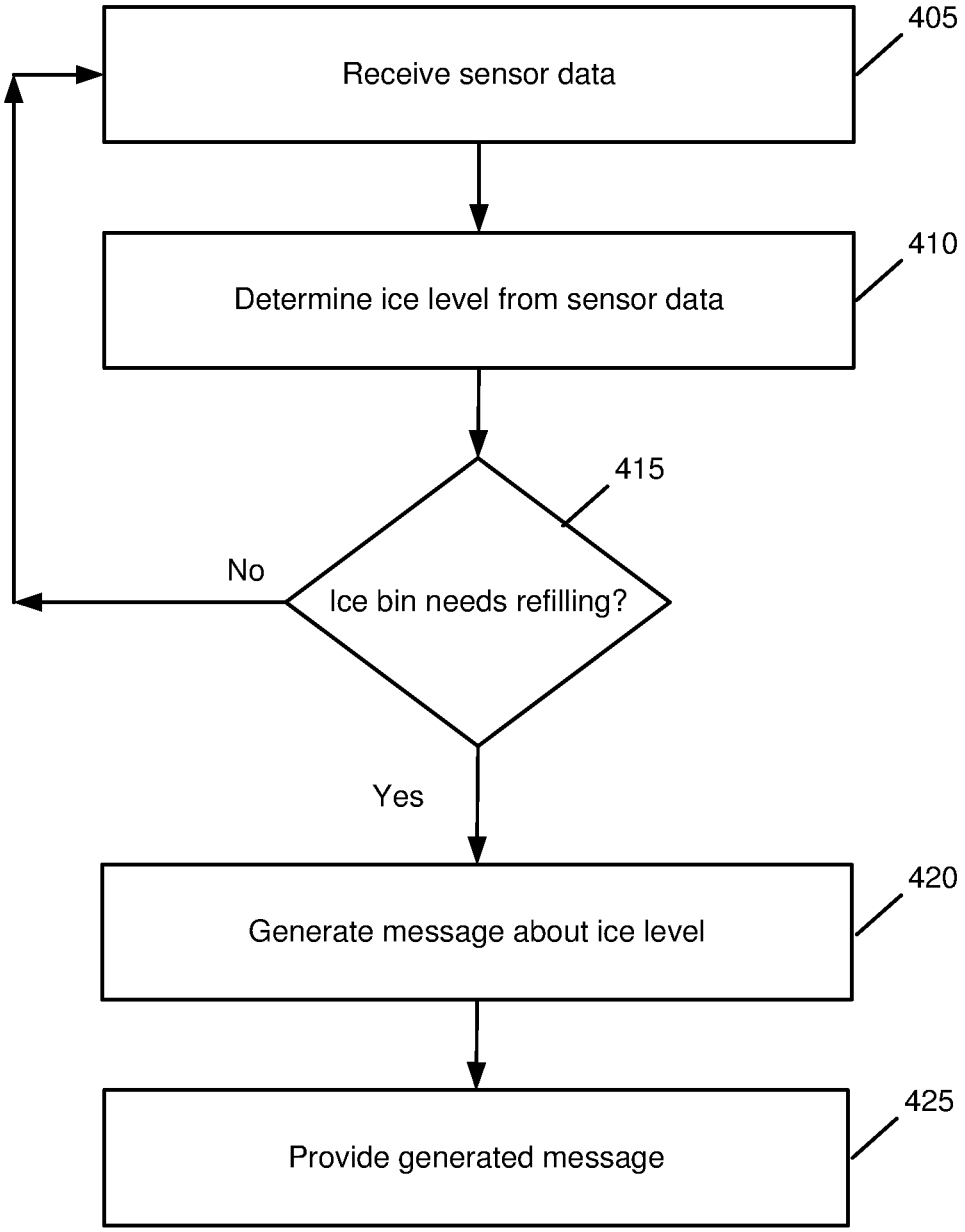
FIG. 4 is an illustration of a method for managing the ice level of an ice bin by a beverage dispenser.

FIG. 4 is an illustration of a method 400 for managing the ice level of an ice bin by a beverage dispenser. The method 400 may be implemented by the beverage dispenser 180.

At 405, sensor data is received. The sensor data 206 may be received from the sensor 105 in the ice bin 110 by the sensor engine 205 of the ice control component 115. The sensor 105 may be an ultrasonic sensor or an optical sensor.

At 410, an ice level is determined. The ice level 102 may be determined by the sensor engine 205. The ice level 102 may represent the height of the ice in the ice bin 110.

At 415, whether the ice bin needs to be refilled is determined. The determination may be made by the control engine 210. The ice bin 110 may need to be refilled when the ice level 102 is below one or more thresholds 107. The thresholds 107 may be set by an employee or manager based on anticipated ice needs for a location associated with the beverage dispenser 180, for example. If the ice bin 110 needs refilling, the method 400 may continue at 420. Else, the method 400 may return to 405 where the control engine 210 may continue to monitor the ice level 102.

At 420, a message is generated about the ice level. The message 212 may be generated by the control engine 210 of the ice control component 115. The message 212 may be an electronic message and may include an indication that the ice bin 110 associated with the beverage dispenser 180 needs ice. The message 212 may indicate an amount of ice that is needed and may also indicate an approximate time when the ice bin 110 is likely to be empty. This may allow an employee or manager to schedule a time to refill the ice bin 110.

At 425, the generated message is provided. The message 212 may be provided to an employee or manager by the control engine 210. The message 212 may an electronic message (e.g., e-mail or SMS) and may be sent electronically to the employee or manager via a network. Depending on the embodiment, in addition to, or instead of the message 212, the control engine 210 may cause the beverage dispenser 180 to signal that more ice is needed by sounding an alarm or by turning on one or more indicator lights.

Figure 5:
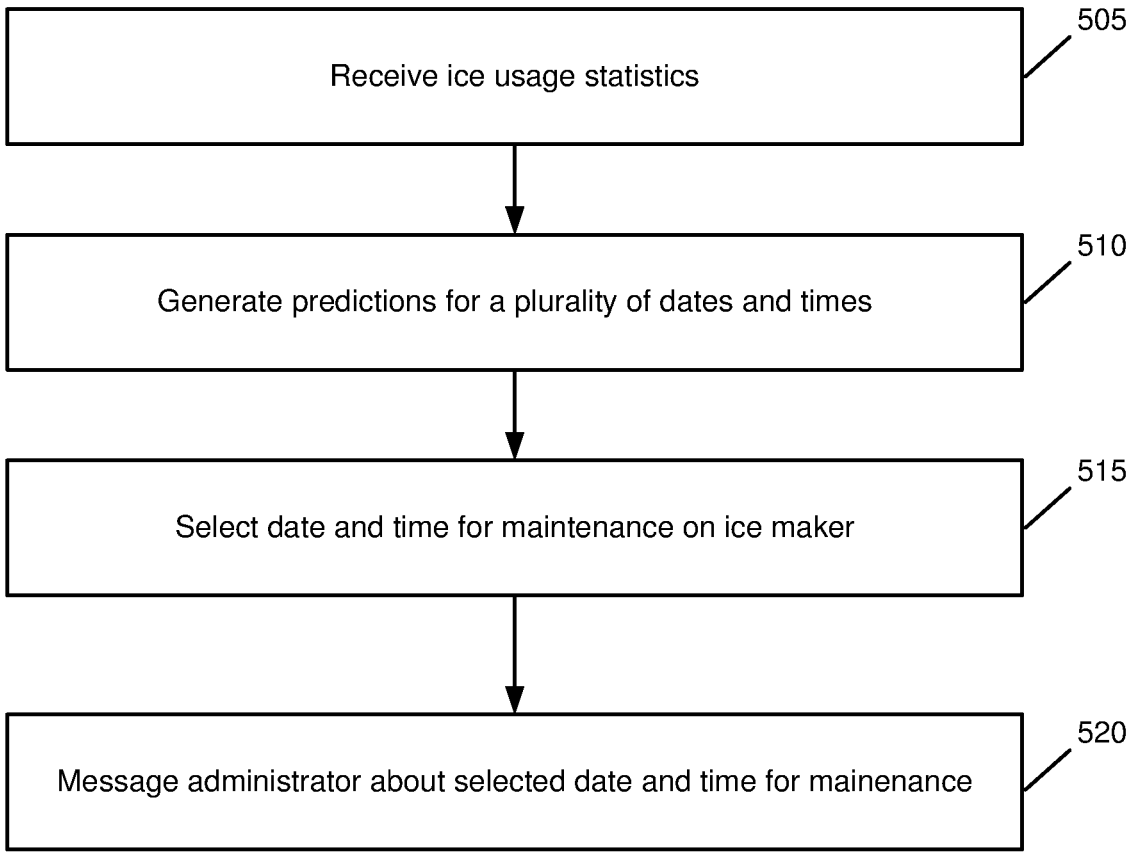
FIG. 5 is an illustration of a method for selecting dates and times for performing maintenance operations on an ice maker by a beverage dispenser.

FIG. 5 is an illustration of a method 500 for selecting dates and times for maintenance operations on an ice maker by a beverage dispenser 180. The method 500 may be implemented by the beverage dispenser 180.

At 505, ice usage statistics are received. The ice usage statistics 208 may be received by the prediction engine 215. The ice usage statistics 208 may have been collected by the sensor engine 205 and may include a variety of statistics about the ice usage of the beverage dispenser 180 such as ice levels 102 measured at certain dates and times.

At 510, predictions are generated for a plurality of dates and times. The predictions 217 may predict ice usage or demand for future dates and times and may be generated by the prediction engine 215 based on the ice usage statistics 208.

At 515, dates and times are selected for maintenance on the ice maker. The selected dates and times may be selected by the control engine 210 by selecting the future dates and times that are likely to have low ice demand and therefore good dates and times to perform ice maker 150 maintenance operations. The maintenance operations may include cleaning the ice maker 150, cycling the ice maker 150, and repairing the ice maker 150.

At 520, an administrator is messaged about the selected dates and times. The administrator may be messaged by the control engine 210 sending an electronic message 212 to the administrator that includes the one or more selected dates and times. The administrator may then select a time for the maintenance operation from those in the message 212.

Figure 6:
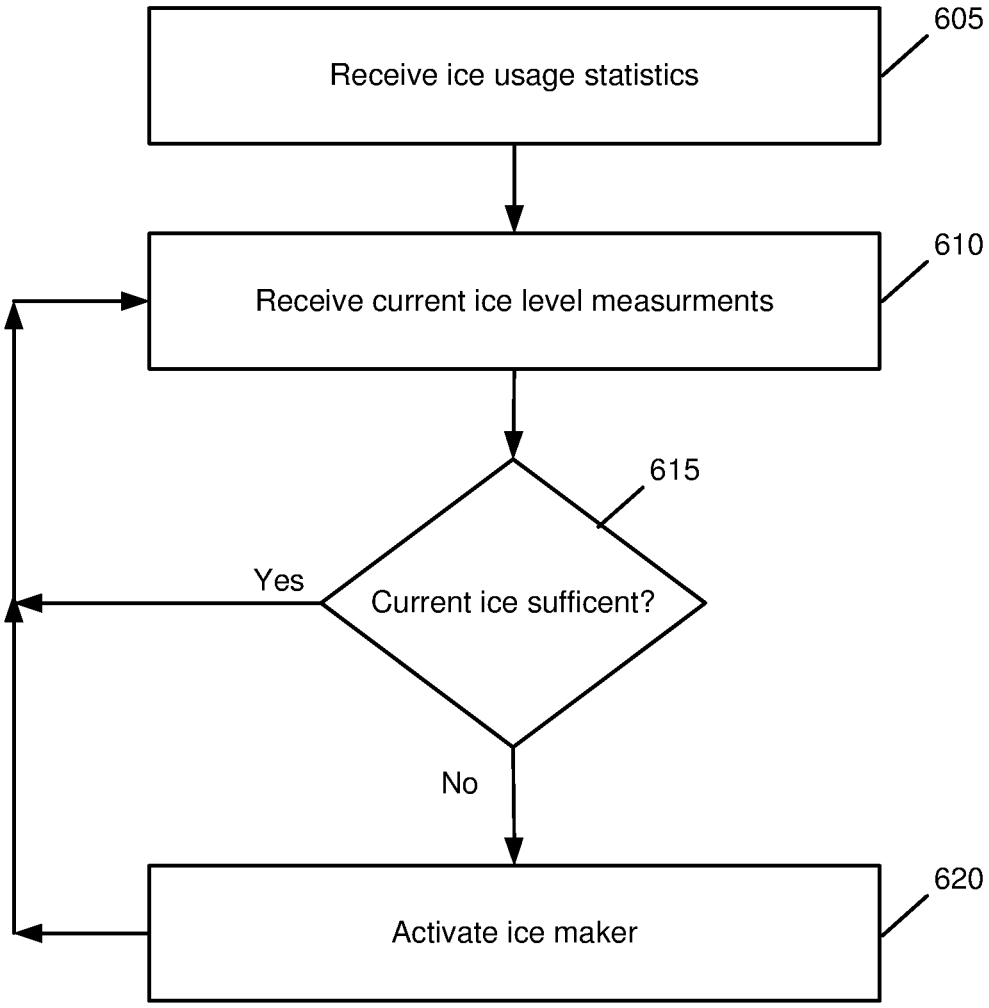
FIG. 6 is an illustration of a method for managing an ice maker using ice usage statistics.

FIG. 6 is an illustration of a method 600 for managing an ice maker using ice usage statistics. The method 600 may be implemented by the beverage dispenser 180.

At 605, ice usage statistics are received. The ice usage statistics 208 may be received by the control engine 210. The ice usage statistics 208 may include statistics about the amount of ice used by the beverage dispenser 180 at a plurality of dates and times.

At 610, current ice level measurements are received. The ice level 102 may be received by the control engine 210 from the sensor engine 205. The ice level 102 may be a current ice level of an ice bin 110 associated with the beverage dispenser 180.

At 615, whether the ice level is sufficient is determined. The control engine 210 may determine that the ice level 102 is sufficient based on a comparison of the current ice level 102 with the predicted ice usage for the current data and time. The predicted ice usage (e.g., the prediction 217) may be based on the ice usage statistics 208. If the current ice level 102 is sufficient, the method 600 may continue at 610 where the current ice level 102 may continue to be monitored. Else, the method 600 may continue to 620.

At 620, the ice maker is activated. The ice maker 150 may be activated by the control engine 210 of the ice control component 115. In some embodiments, the control engine 210 may activate the ice maker 150 by sending an instruction 213 to the ice maker 150. The ice maker 150 may then begin making ice in response to the instruction 213.

Figure 7:
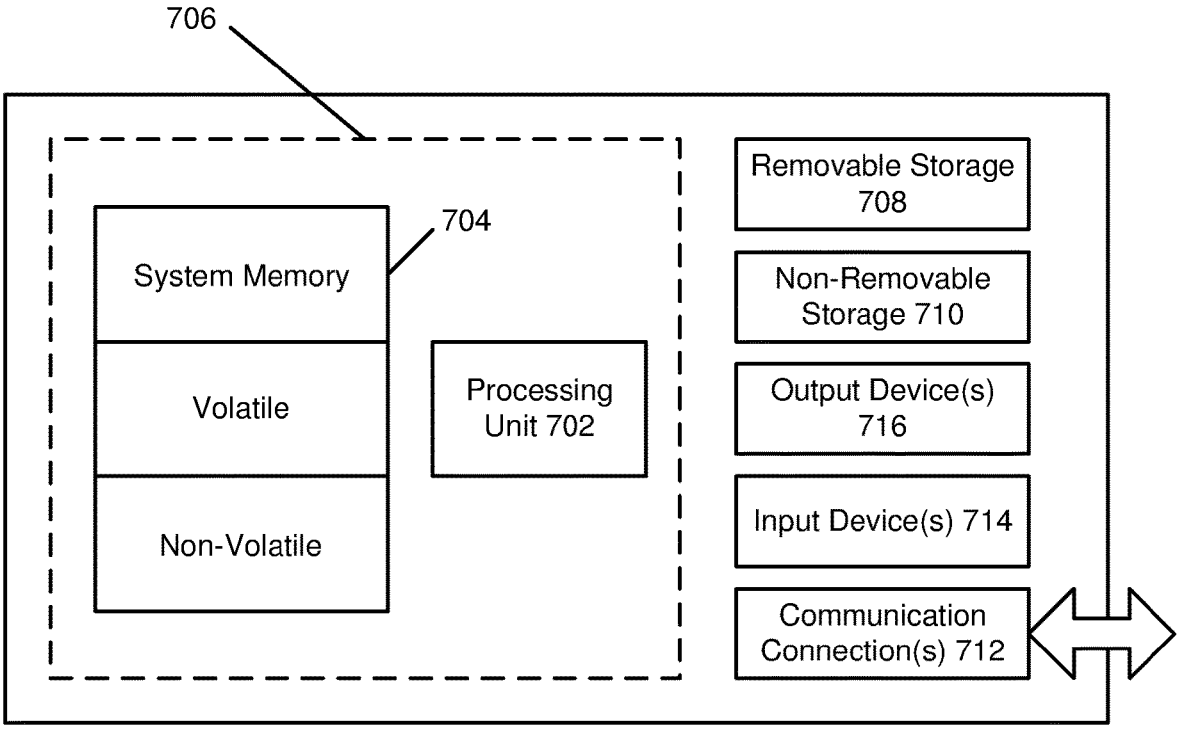
FIG. 7 shows an exemplary computing environment in which example embodiments and aspects may be implemented.

FIG. 7 shows an exemplary computing environment in which example embodiments and aspects may be implemented. The computing device environment is only one example of a suitable computing environment and is not intended to suggest any limitation as to the scope of use or functionality.

Numerous other general purpose or special purpose computing devices environments or configurations may be used. Examples of well-known computing devices, environments, and/or configurations that may be suitable for use include, but are not limited to, personal computers, server computers, handheld or laptop devices, multiprocessor systems, microprocessor-based systems, network personal computers (PCs), minicomputers, mainframe computers, embedded systems, distributed computing environments that include any of the above systems or devices, and the like.

Computer-executable instructions, such as program modules, being executed by a computer may be used. Generally, program modules include routines, programs, objects, components, data structures, etc. that perform particular tasks or implement particular abstract data types. Distributed computing environments may be used where tasks are performed by remote processing devices that are linked through a communications network or other data transmission medium. In a distributed computing environment, program modules and other data may be located in both local and remote computer storage media including memory storage devices.

With reference to FIG. 7, an exemplary system for implementing aspects described herein includes a computing device, such as computing device 700. In its most basic configuration, computing device 700 typically includes at least one processing unit 702 and memory 704. Depending on the exact configuration and type of computing device, memory 704 may be volatile (such as random access memory (RAM)), non-volatile (such as read-only memory (ROM), flash memory, etc.), or some combination of the two. This most basic configuration is illustrated in FIG. 7 by dashed line 706.

Computing device 700 may have additional features/functionality. For example, computing device 700 may include additional storage (removable and/or non-removable) including, but not limited to, magnetic or optical disks or tape. Such additional storage is illustrated in FIG. 7 by removable storage 708 and non-removable storage 710.

Computing device 700 typically includes a variety of computer readable media. Computer readable media can be any available media that can be accessed by the device 700 and includes both volatile and non-volatile media, removable and non-removable media.

Computer storage media include volatile and non-volatile, and removable and non-removable media implemented in any method or technology for storage of information such as computer readable instructions, data structures, program modules or other data. Memory 704, removable storage 708, and non-removable storage 710 are all examples of computer storage media. Computer storage media include, but are not limited to, RAM, ROM, electrically erasable program read-only memory (EEPROM), flash memory or other memory technology, CD-ROM, digital versatile disks (DVD) or other optical storage, magnetic cassettes, magnetic tape, magnetic disk storage or other magnetic storage devices, or any other medium which can be used to store the desired information and which can be accessed by computing device 700. Any such computer storage media may be part of computing device 700.

Computing device 700 may contain communication connection(s) 712 that allow the device to communicate with other devices. Computing device 700 may also have input device(s) 714 such as a keyboard, mouse, pen, voice input device, touch input device, etc. Output device(s) 716 such as a display, speakers, printer, etc. may also be included. All these devices are well known in the art and need not be discussed at length here.

It should be understood that the various techniques described herein may be implemented in connection with hardware components or software components or, where appropriate, with a combination of both. Illustrative types of hardware components that can be used include Field-programmable Gate Arrays (FPGAs), Application-specific Integrated Circuits (ASICs), Application-specific Standard Products (ASSPs), System-on-a-chip systems (SOCs), Complex Programmable Logic Devices (CPLDs), etc. The methods and apparatus of the presently disclosed subject matter, or certain aspects or portions thereof, may take the form of program code (i.e., instructions) embodied in tangible media, such as floppy diskettes, CD-ROMs, hard drives, or any other machine-readable storage medium where, when the program code is loaded into and executed by a machine, such as a computer, the machine becomes an apparatus for practicing the presently disclosed subject matter.

Although exemplary implementations may refer to utilizing aspects of the presently disclosed subject matter in the context of one or more stand-alone computer systems, the subject matter is not so limited, but rather may be implemented in connection with any computing environment, such as a network or distributed computing environment. Still further, aspects of the presently disclosed subject matter may be implemented in or across a plurality of processing chips or devices, and storage may similarly be effected across a plurality of devices. Such devices might include personal computers, network servers, and handheld devices, for example.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A beverage dispenser comprising:

a computing device comprising a sensor engine, a control engine, and a prediction engine;

a sensor; and an ice bin, wherein the sensor engine is adapted to receive sensor data from the sensor and determine a current ice level in the ice bin using the sensor data, wherein the control engine is adapted to generate an instruction for an ice maker to being making ice when the determined current ice level is below one or more thresholds and to generate an instructions for the ice maker to stop making ice when the determined current ice level is above the one or more thresholds, wherein the control engine is adapted to record ice usage statistics based on the sensor data, wherein the ice usage statistics include ice levels determined by the sensor engine and a date and time that each ice level was determined, wherein the prediction engine is adapted to generate a predicted future ice demand of the beverage dispenser using the ice usage statistics, and wherein the control engine is adapted to increase or decrease the one or more thresholds based on the predicted future ice demand.

2. The beverage dispenser of claim 1, wherein the sensor is an ultrasonic sensor or an optical sensor.

3. The beverage dispenser of claim 1, wherein the computing device is further adapted to recommend a time to service the ice maker based on the predicted future ice demand.

4. The beverage dispenser of claim 1, wherein the computing device is further adapted to selectively activate or deactivate the ice maker based on the predicted future ice demand.

5. The beverage dispenser of claim 1, wherein the one or more thresholds comprise a minimum ice threshold, and the control engine is further adapted to generate the instruction for the ice maker to being making ice when the current ice level measurement is below the minimum ice threshold.

6. The beverage dispenser of claim 1, wherein the one or more thresholds comprise a maximum ice threshold, and the control engine is further adapted to generate the instruction for the ice maker to stop making ice when the current ice level measurement is below the maximum ice threshold.

7. The beverage dispenser of claim 1, wherein the computing device is further adapted to report the current ice level measurement to an operator.

8. A method for operating an ice maker comprising:

receiving, via a sensor engine, sensor data from a sensor and determining, via the sensor engine, a current ice level in an ice bin using the sensor data;

generating, via a control engine, an instruction for the ice maker to begin making ice when the determined current ice level is below one or more thresholds and generating, via the control engine, an instruction for the ice maker to stop making ice when the determined current ice level is above one or more thresholds;

recording, via the control engine, ice usage statistics based on the sensor data, wherein the ice usage statistics include ice levels determined by the sensor engine and a data and time that each ice level was determined;

generating, via a prediction engine, predicted future ice demand of the ice maker using the ice usage statistics; and increasing or decreasing, via the control engine, the one or more thresholds based on the predicted future ice demand.

9. The method of claim 8, wherein the sensor is an ultrasonic sensor or an optical sensor.

10. The method of claim 8, further comprising recording the current ice level measurement and a current date and time as ice usage statistics.

11. The method of claim 10, further comprising predicting future ice demand based on the ice usage statistics.

12. The method of claim 11, further comprising recommending a time to service the ice maker based on the predicted future ice demand.

13. The method of claim 11, further comprising selectively activating or deactivating the ice maker based on the predicted future ice demand.

14. The method of claim 8, wherein the one or more thresholds comprise a minimum ice threshold, and further comprising determining that the current ice level measurement satisfies the one or more threshold ice levels when the current ice level measurement is below the minimum ice threshold.

15. The method of claim 8, wherein the one or more thresholds comprise a maximum ice threshold, and further comprising determining that the current ice level measurement satisfies the one or more threshold ice levels when the current ice level measurement is below the maximum ice threshold.

16. The method of claim 8, further comprising reporting the current ice level measurement to an operator.

17. A beverage dispenser comprising:

a computing device comprising a sensor engine, a control engine, and a prediction engine;

a sensor; and an ice bin, wherein the sensor engine is adapted to receive sensor data from the sensor, wherein the control engine is adapted to record ice usage statistics for an ice maker based on the sensor data, wherein the ice usage statistics comprise ice level measurements taken by the sensor and a date and a time that each ice level was determined;

wherein the prediction engine is adapted to generate predicted future ice demand of the beverage dispenser using the ice usage statistics, and wherein the control engine is adapted to generate an instruction for the ice maker to activate or deactivate based on the predicted future ice demand.

18. The beverage dispenser of claim 17, wherein the sensor is an ultrasonic sensor or an optical sensor.

* * * * *